US006318976B1

(12) United States Patent
Hsieh

(10) Patent No.: US 6,318,976 B1
(45) Date of Patent: Nov. 20, 2001

(54) HEAT DISSIPATION FAN

(76) Inventor: Hsin-Mao Hsieh, No. 6, East Section, Chiao Nan Li, Industrial 6th Rd., Pingtung City, Pingtung Hsien (TW)

( * ) Notice: Subject to any disclaimer, the term of this patent is extended or adjusted under 35 U.S.C. 154(b) by 0 days.

(21) Appl. No.: 09/546,413

(22) Filed: Apr. 10, 2000

(51) Int. Cl.[7] ..... F04B 17/00; F04B 35/04

(52) U.S. Cl. ..... 417/423.12; 417/178; 310/90

(58) Field of Search ..... 417/423.12, 354, 417/423.7, 423.1, 366; 440/12; 415/218.1, 178; 310/90, 40.5; 384/517

(56) References Cited

U.S. PATENT DOCUMENTS 3,889,626 * 6/1975 Kakihara ..... 440/12
4,373,861 * 2/1983 Papst et al. ..... 415/218.1
4,801,252 * 1/1989 Wrobel ..... 417/354
5,152,676 * 10/1992 Ohi ..... 417/354
5,176,509 * 1/1993 Schmider et al. ..... 417/423.7
5,264,748 * 11/1993 Ootsuka et al. ..... 310/90
5,666,011 * 9/1997 Hong ..... 310/40.5
5,997,183 * 12/1999 Horug ..... 384/517
6,015,274 * 1/2000 Bias et al. ..... 417/423.1
6,050,786 * 4/2000 Lin ..... 417/366
6,132,170 * 10/2000 Horug ..... 415/178
6,183,221 * 2/2001 Hsieh ..... 417/423.12

* cited by examiner

*Primary Examiner*—Teresa Walberg
*Assistant Examiner*—Leonid M Fastovsky
(74) *Attorney, Agent, or Firm*—Alan Kamrath; Rider, Bennett, Egan & Arundel, LLP

(57) ABSTRACT

A heat dissipation fan has a casing, a stator fixedly received in the casing, a sleeve with a central hole securely attached to the stator, a lubricating bearing with lubrication oil contained therein mounted in the sleeve, a fan rotatably mounted in the casing and having a magnet mounted therein to be a rotor, a shaft extending from the fan and securely received in the lubricating bearing and a locking disk securely mounted on the shaft to lock the lubricating bearing on said shaft. The lubricating bearing has a central hole defined therein, a chamber defined in the bottom end of said bearing and at least one oil groove longitudinally defined in the outer periphery of said bearing. This can lubricate the shaft and guide the lubrication oil to avoid noise and oil from leaking from the sleeve and drying out the bearing. Consequently, the useful life of the heat dissipation fan will be increased.

9 Claims, 5 Drawing Sheets

HEAT DISSIPATION FAN

BACKGROUND OF THE INVENTION

1. Field of the Invention

The present invention relates to a heat dissipation fan, and more particularly to a heat dissipation fan that has a lubricating bearing with an oil guide to prolong the life of the heat dissipation fan.

2. Description of Related Art

With reference to FIG. 5, a conventional heat dissipation fan in accordance with the prior art comprises a casing (30) and a fan (32) rotatably mounted in the casing (30). A stator (34) with an electromagnet formed in the stator (34) is securely fixed in the casing (30). A permanent magnet (322) is mounted in the fan (32) to be a rotor, such that the fan (32) can rotate due to the interaction between the magnetic forces in stator (34) and the permanent magnet (322). A sleeve (38) is securely mounted on a base (302) formed in the casing (30) and pressed into the stator (34). A lubricating bearing (36) with lubrication oil contained therein is pressed into the sleeve (38). A shaft (324) extends from the fan (32) and through the bearing (36). A locking disk (50) is mounted on the free end of the shaft (324) to securely hold the bearing (36) on the shaft (324) so the fan (32) can rotate relative to the casing (30) with very little friction. Because the lubrication oil will flow out of the bearing (36) when the fan (32) is in operation, a seal (42) and a gasket (40) must be mounted on the shaft (324) at each end of said lubricating bearing (36) to keep the lubrication oil from leaking out of the sleeve (38) and drying out the bearing (36).

However, during the assemble of the conventional heat dissipation fan, the sleeve (38) must first be pressed into the casing (30) base (302). Then the casing (30) must be turned over to install the circuit board (35) and stator (34) in the casing (30) and the lubricating bearing (36) into the sleeve (38) with a specific hand tool. After mounting the seal (42) and the gasket (40) on the shaft (324), the shaft (324) extends through the central hole of the bearing (36). The casing (30) must be turned over again to install the second seal (46), gasket (44) and the locking disk (50) on the free end of the shaft (324) with a specific hand tool. Finally, a cover (39) is mounted on the base (302) of the casing (30) to close the base (302). Consequently, the assembly of the conventional heat dissipation fan is very difficult and tedious. In addition, because the heat dissipation fan usually works with a small object like the CPU of a computer, the volume of the heat dissipation fan must be small, and the components of the heat dissipation fan are very tiny. This will further increase the difficulty and tedium of assembling the conventional heat dissipation fan. Furthermore, the conventional heat dissipation fan does not have any oil guilds, so the lubrication oil easily flows out of the sleeve (38). Consequently, the bearing will easily dry out, and the useful life of the heat dissipation fan will be decreased.

To overcome the shortcomings, the present invention tends to provide an improved heat dissipation fan to mitigate or obviate the aforementioned problems.

SUMMARY OF THE INVENTION

The main objective of the invention is to provide an improved heat dissipation fan having a casing, a circuit board, a stator, a sleeve, a lubricating bearing, a fan, a shaft and a locking disk. The lubricating bearing contained lubrication oil. The fan is rotatably mounted in the casing. The shaft extends from the fan and through the lubricating bearing. A locking disk is securely mounted on the free end of the shaft. has a central hole is defined in the lubricating bearing. A chamber is defined in the bottom end of the bearing, and at least one oil groove is longitudinally defined in the outer periphery of the bearing. The oil groove provides a guide to the lubrication oil to keep the oil from flowing out of the sleeve.

Other objects, advantages and novel features of the invention will become more apparent from the following detailed description when taken in conjunction with the accompanying drawings.

DETAILED DESCRIPTION OF PREFERRED EMBODIMENT

Figure 1:
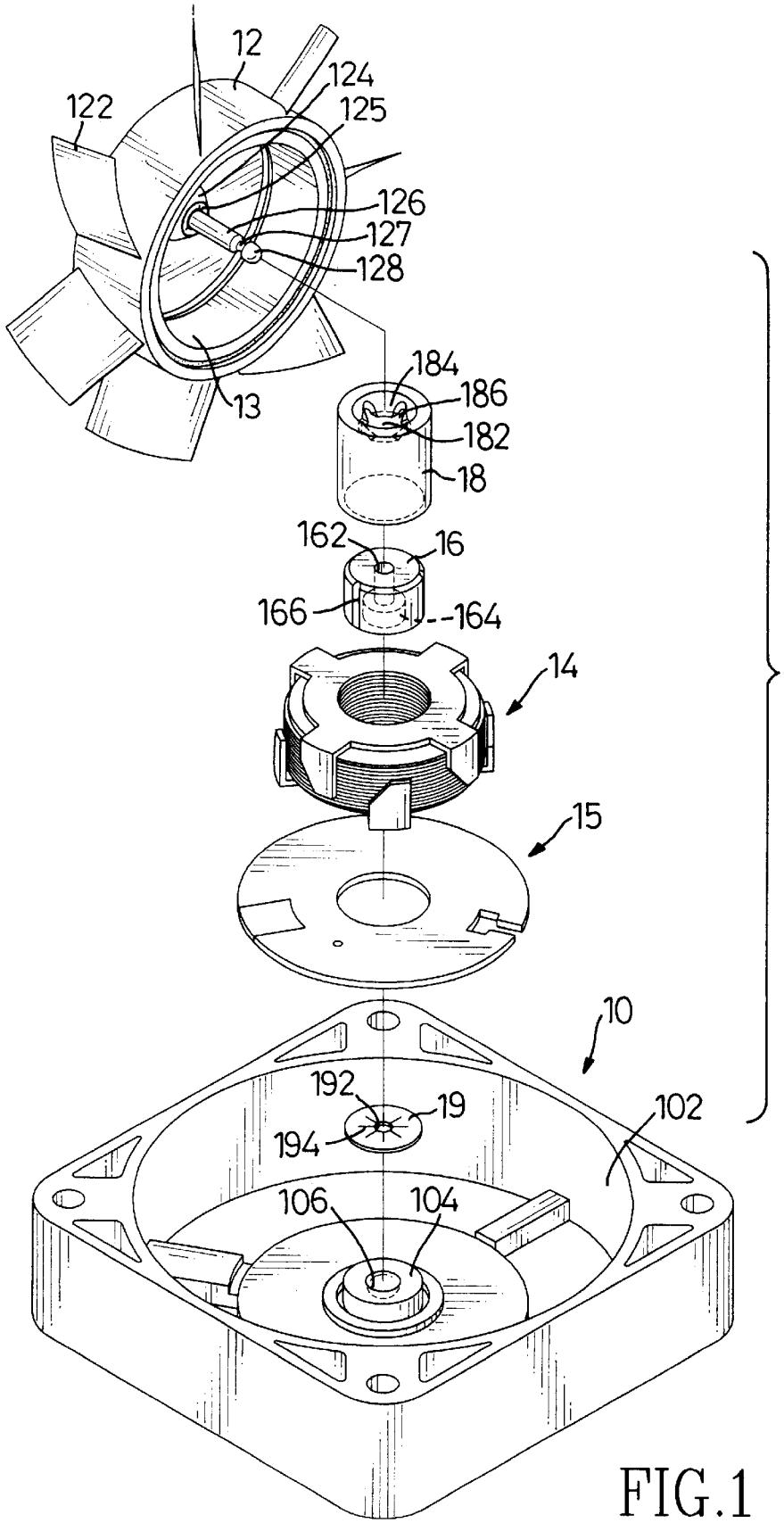
FIG. 1 is an exploded perspective view of a heat dissipation fan in accordance with the present invention.
Figure 2:
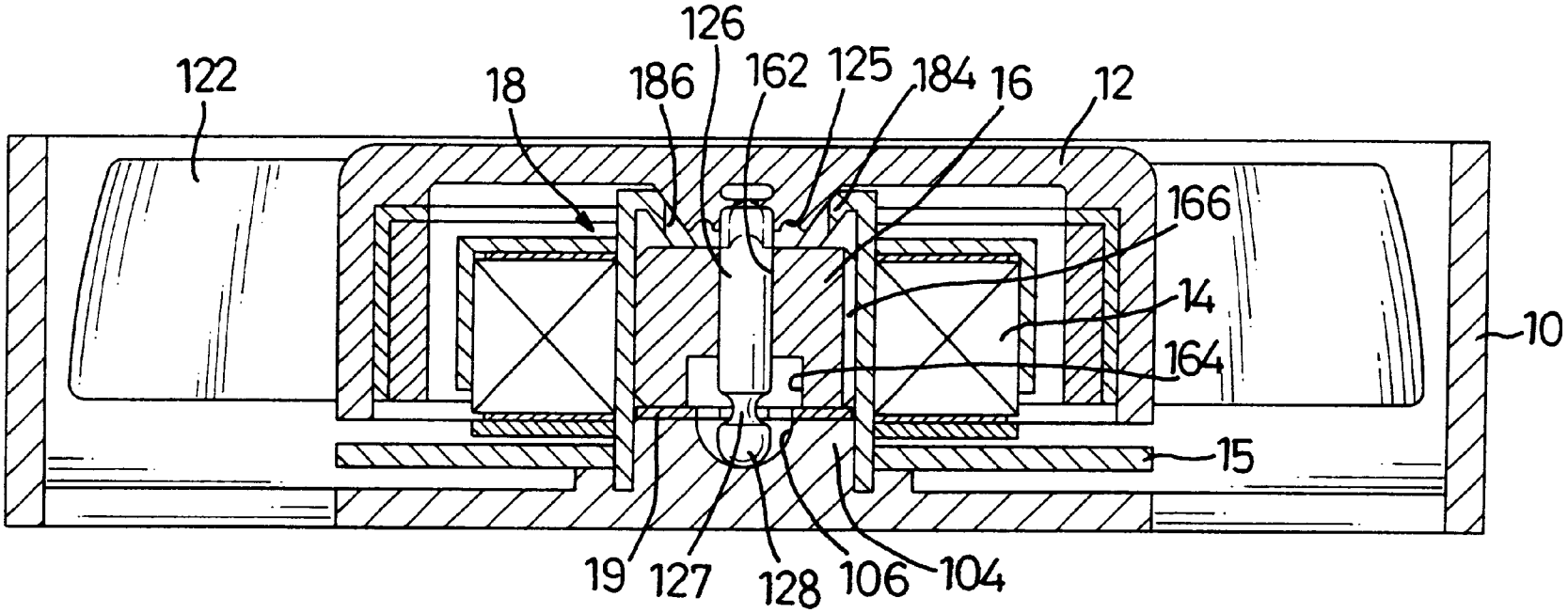
FIG. 2 is a side plan view in partial section of the heat dissipation fan in FIG. 1.

With reference to FIGS. 1 and 2, a heat dissipation fan in accordance with the present invention comprises a casing (10) and a fan (12) with multiple blades (122) arranged on the outer periphery rotatably mounted in the casing (10). A chamber (102) is defined in the casing (10) to receive the fan (12). A stator (14) is securely mounted in the chamber (102) of the casing (10). A permanent magnet (13) mounted in the fan (12) to be the rotor. A sleeve (18) is pressed into the stator (14) and is securely mounted in the casing (10) by pressing the central hole (182) of the sleeve (18) onto a protrusion (104) integrally formed at the center of the inside face of the casing (10) chamber (102).

A lubricating bearing (16) with lubrication oil contained therein is securely mounted in the sleeve (18). A central hole (162) is defined in the lubricating bearing (16). A chamber (164) communicating with the central hole (162) is defined in the bottom end of the lubricating bearing (16). At least one oil groove (166) is longitudinally defined in the outer periphery of the lubricating bearing (16).

An inclined flange (184) extends toward the central hole (182) from the top end of the sleeve (18) and abuts the top end of the lubricating bearing (16), such that an annular space is defined between the top end of the bearing (16) and the sleeve (18) flange (184). At least one recess (186) is defined in the free end of the flange (184). In addition, a cone portion (124) is formed on the fan (12) and abuts the inclined flange (184) of the sleeve (18). An annular groove (125) is defined in the cone portion (124) and faces the central hole (182) of the sleeve (18).

A shaft (126) extends from the cone portion (124) of the fan (12), into the sleeve (18) and through the central hole (162) of the lubricating bearing (16). A neck (127) is defined near the free end of the shaft (126), such that a head (128) is formed on the free end of the shaft (126). A locking disk (19) with a central hole (192) securely engages with the neck (127) in the shaft (126) to securely hold the bearing (16) on the shaft (124). The diameter of the central hole (192) of the locking disk (19) is smaller than the diameter of the shaft (124), and multiple slits (194) extend radially from the central hole (192) of the disk (19). By such an arrangement, when the head (128) of the shaft (126) extends into the central hole (192) of the locking disk (19), the central hole (192) will deform and enlarge for the shaft (126) to pass through the hole (192). When the head (128) of the shaft (126) passes through the central hole (192) of the locking disk (19), the central hole (192) of the disk (19) will rebound to its original configuration and be held in the neck (127) of the shaft (126). In addition, a recess (106) is defined in the protrusion (104) of the casing (10) to accommodate the head (128) of the shaft (126).

Figure 3:
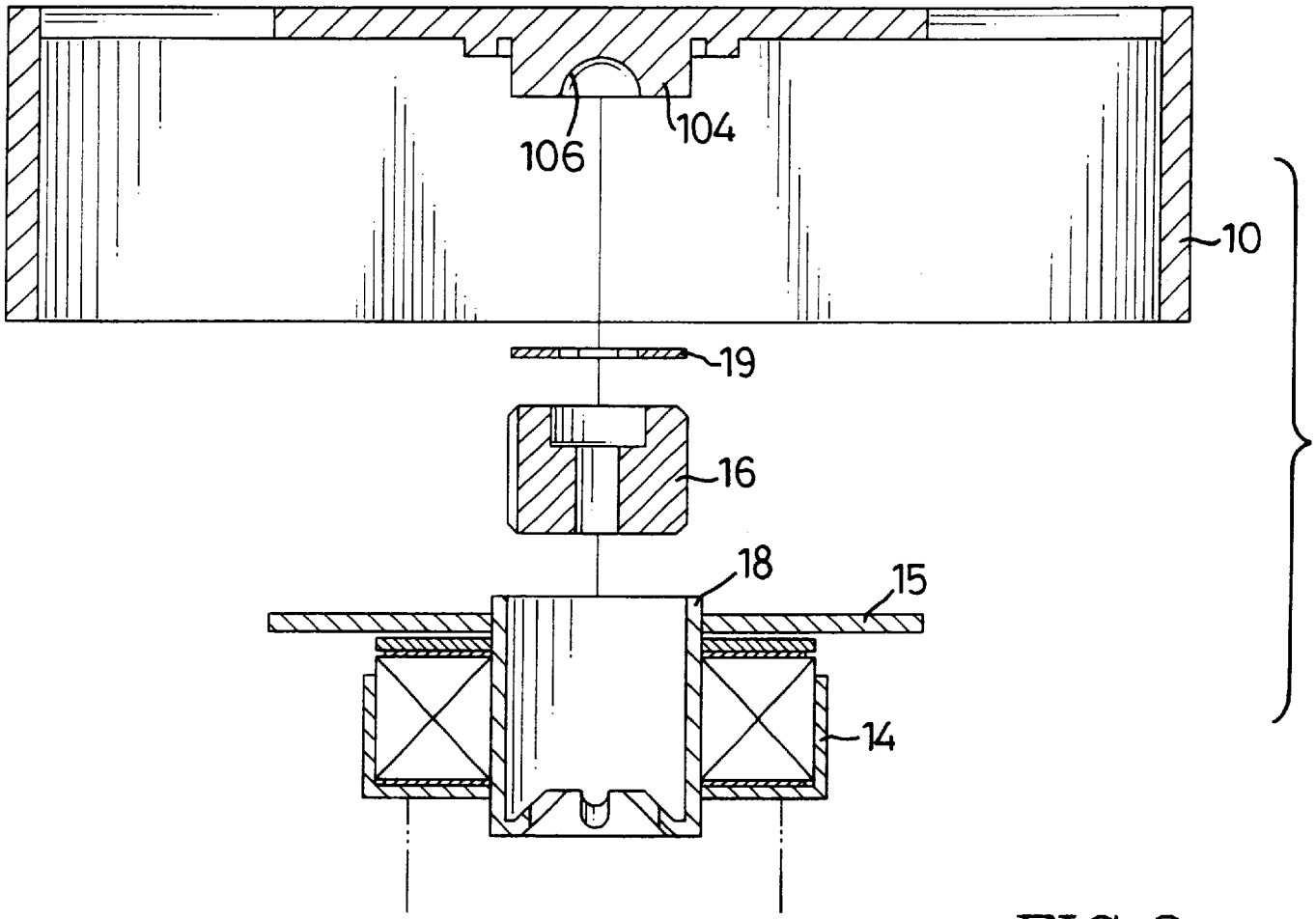
FIG. 3 is an exploded side plan view of the heat dissipation fan in FIG. 1 showing the assembly operation.

With reference to FIGS. 1–3, to assemble the heat dissipation fan the sleeve (18) is positioned in an assembly jig with the flange (184) downward, and the stator (14) and the circuit board (I 5) are sequentially pressed onto the outer periphery of the sleeve (1 8). The lubricating bearing (16) is pressed into the sleeve (18), and the locking disk (19) is put into the sleeve (18) to abut the lubricating bearing (16). Then the protrusion (104) in the casing (10) is pressed into the central hole (182) of the sleeve (18) and abuts the locking disk (19), such that the sleeve (18) with the stator (14), the circuit board (15), the lubricating bearing (16) and the locking disk (19) are securely mounted in the casing (10). Then the casing (10) is turned over, and the fan (12) shaft (126) is pushed into the sleeve (18). When the head (128) of the shaft (126) extends through the central hole (162) of the lubricating bearing (16), the shaft (126) will penetrate the locking disk (19) central hole (192) and be automatically locked into position. Because only one step requires turning the assembly over during the assembly of the heat dissipation fan, the manufacturing process is significantly simplified, and the cost and time of manufacturing the heat dissipation fan is decreased.

Figure 4:
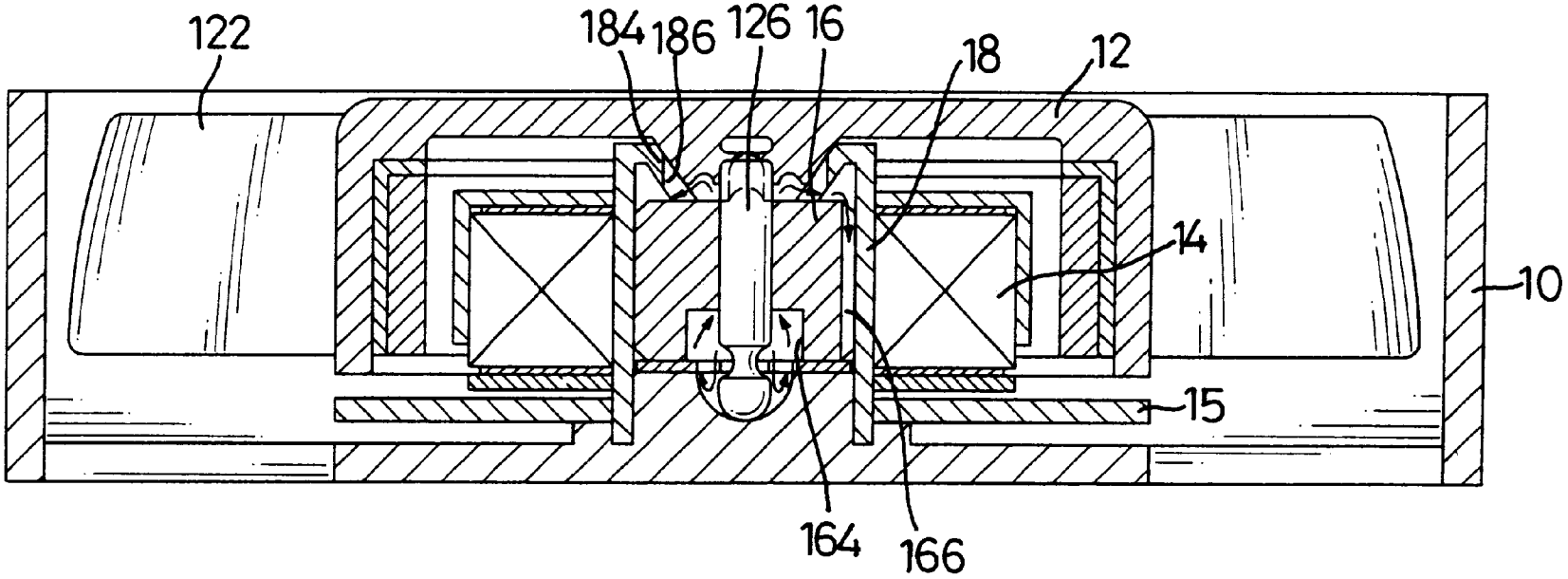
FIG. 4 is a side plan view in partial section of the heat dissipation fan in FIG. 1 showing the direction of the lubrication oil flow.
Figure 5:
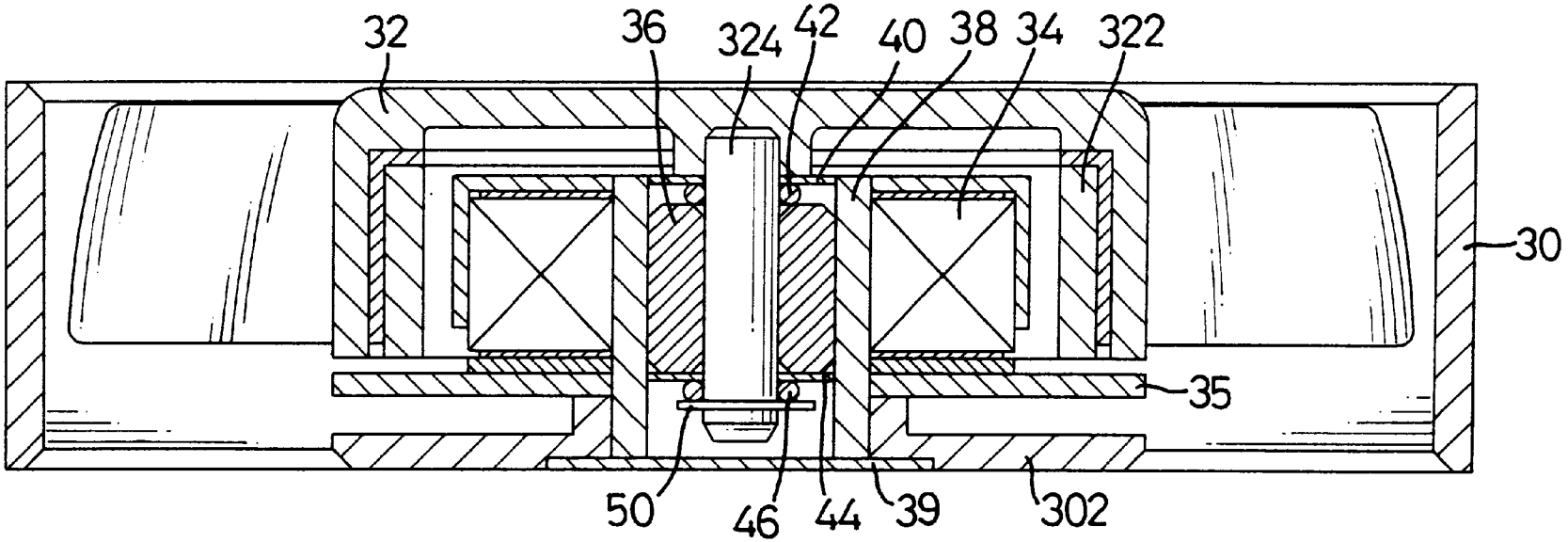
FIG.5 PRIOR ART
FIG. 5 is a side plan view in partial section of a conventional heat dissipation fan in accordance with the prior art.

With reference to FIG. 4, the fan (12) and the shaft (126) in operation will rotate relative to the sleeve (18) due to the interaction of the stator (14) and the permanent magnet (13) in the fan (12). Because the shaft (126) extends through the lubricating bearing (16), the shaft (126) will rotate freely with very little friction. In addition, any lubrication oil that flows from the lubricating bearing when the heat dissipation fan is in operation will flow into the chamber (164) and the space between the bearing (16) and the sleeve (18) flange (184) through the recess (186) in the flange (184). The oil flowing into the space will recycle through the oil grooves (166). This keeps the lubrication oil from leaking out of the sleeve (18) and drying out the bearing (16). The oil flowing into the chamber (164) will be stored in the chamber (164) and the recess (106) of the protrusion (104), such that the oil can provide a lubricating effect to the shaft (126). This can further reduce the friction between the shaft (126) and the lubricating bearing (16) to avoid noise and wear. Therefore, the oil guide in the heat dissipation fan extends the useful life of the heat dissipation fan.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A heat dissipation fan comprising:

a casing;

a stator fixedly received in said casing;

a sleeve with a central hole securely attached to said stator and an inclined flange surrounding said central hole and extended from a top end of said sleeve central hole with at least one recess defined in said flange;

a lubricating bearing with lubrication oil contained therein and mounted in said sleeve, with a top end of said lubricating bearing abutting said sleeve flange and an annular space being defined between said bearing and said sleeve flange;

a fan rotatably mounted in said casing and having a permanent magnet mounted therein to be a rotor;

a shaft extending from said fan and securely received in said central hole of said lubricating bearing; and a locking disk securely mounted on a free end of said shaft to lock said lubricating bearing on said shaft;

wherein said lubricating bearing has a central hole defined therein, a chamber defined in a bottom end of said bearing and at least one oil groove longitudinally defined on the outer periphery of said bearing so as to provide a guide and storing effect to the lubrication oil.

2. The heat dissipation fan as claimed in claim 1 further comprising a circuit board mounted in said casing and electrically connected with said stator.

3. The heat dissipation fan as claimed in claim 1, wherein a protrusion is integrally formed on said casing to be securely pressed into a bottom end of said sleeve central hole.

4. The heat dissipation fan as claimed in claim 3, wherein a recess is defined in said protrusion of said casing to receive a free end of said shaft therein.

5. The heat dissipation fan as claimed in claim 1, wherein said fan has a cone portion from where the shaft extends, said cone portion abuts said inclined flange of said sleeve.

6. The heat dissipation fan as claimed in claim 5, wherein an annular groove is defined in said cone portion and faces said central hole of said sleeve.

7. The heat dissipation fan as claimed in claim 1, wherein a neck is defined in said shaft outer periphery near a free end of said shaft to engage with said locking disk.

8. The heat dissipation fan as claimed in claim 7, wherein said locking disk has a central hole to securely receive said shaft therein.

9. The heat dissipation fan as claimed in claim 8, wherein the diameter of said central hole of said locking disk is smaller than that of said shaft; and multiple slits extend radially from said central hole of said disk.

* * * * *